US007441279B1

(12) United States Patent
Lewis

(10) Patent No.: US 7,441,279 B1
(45) Date of Patent: Oct. 28, 2008

(54) METHOD AND APPARATUS FOR KEEPING WARM WHILE IN A TREE STAND

(76) Inventor: William Lewis, Apple Avenue, P.O. Box 656, Pineville, WV (US) 24874-0656

( * ) Notice: Subject to any disclaimer, the term of this patent is extended or adjusted under 35 U.S.C. 154(b) by 150 days.

(21) Appl. No.: 10/691,683

(22) Filed: Oct. 23, 2003

Related U.S. Application Data

(60) Provisional application No. 60/420,992, filed on Oct. 24, 2002.

(51) Int. Cl.
*A41D 13/00* (2006.01)
*A47G 9/08* (2006.01)

(52) U.S. Cl. ..... 2/69.5; 2/69; 2/1; 5/413 R

(58) Field of Classification Search ..... 2/69, 2/69.5, 82, 83, 84, 85, 94–96, 243.1; 182/179.1, 182/187, 186.4; 135/909, 902, 117, 161, 135/88.15, 901, 96, 90, 95, 143, 158, 156; 5/482, 922, 923, 413 R, 413 AM
See application file for complete search history.

(56) References Cited

U.S. PATENT DOCUMENTS

| | | | | |
|---|---|---|---|---|
| 1,915,044 | A * | 6/1933 | Anderson | 2/69 |
| 2,230,689 | A * | 2/1941 | Kemp | 2/69 |
| 2,242,130 | A * | 5/1941 | Hutchison | 2/69.5 |
| 2,459,352 | A * | 1/1949 | Williams | 2/69 |
| 2,705,325 | A * | 4/1955 | Bogenberger | 2/69 |
| 3,837,006 | A | 9/1974 | Laseman | 2/89 |
| 4,241,721 | A * | 12/1980 | Holly | 126/204 |
| 4,507,805 | A | 4/1985 | Calutoiu | 2/69 |
| 4,893,586 | A * | 1/1990 | Carson | 119/482 |
| 4,998,296 | A * | 3/1991 | Stames | 2/458 |
| 5,416,938 | A * | 5/1995 | Li | 5/494 |
| 5,526,533 | A | 6/1996 | Plemmons, Sr. | 2/79 |
| 5,630,439 | A * | 5/1997 | Hutto | 135/90 |
| 6,042,189 | A * | 3/2000 | Wellman | 297/465 |
| 6,539,966 | B2 * | 4/2003 | Raines et al. | 135/158 |

OTHER PUBLICATIONS

Campmor Catalog, New Year 2000, p. 41. Cherry Tree Supplex Nylon/Polartec 300 Two-Zip Snowsuit.*

* cited by examiner

*Primary Examiner*—Gloria Hale
(74) *Attorney, Agent, or Firm*—Steptoe & Johnson PLLC

(57) ABSTRACT

An apparatus for keeping a person warm while in a stand having a base connected to a tree, including a generally tubular length of material having an open end and a closed end, wherein the closed end includes a fastener for securing the apparatus to the base of the stand. A user simply inserts one or both of his or her feet and legs through the open end of the apparatus and pulls the open end of the apparatus up to a desired height. The apparatus is maintained at the desired height by an elastic band extending around the circumference of the open end.

6 Claims, 4 Drawing Sheets

METHOD AND APPARATUS FOR KEEPING WARM WHILE IN A TREE STAND

RELATED APPLICATIONS

The present application claims the benefit of a Provisional Application of Ser. No. 60/420,992 filed Oct. 24, 2002 by the present inventor, which is incorporated by reference in its entirety.

BACKGROUND OF THE INVENTION

1. Field of the Invention

This invention relates to outdoor clothing, and more specifically to an apparatus for keeping a person warm while he or she is in a tree stand.

2. Related Art

Outdoor enthusiasts and others spending long periods of time outside during cold or inclement weather often protect themselves from the elements using insulated and/or waterproof outdoor apparel. Additionally, some outdoor activities, such as hunting or observing sporting events, may require an individual to sit or remain relatively motionless for long periods of time. When hunting, a hunter may sit in one spot, such as in a tree stand, for hours at a time waiting for game to appear. Long periods of inactivity combined with cold weather conditions can make a hunter extremely cold if adequate outdoor apparel is not worn. Such outdoor apparel cannot interfere with the hunter's ability to shoot accurately, however, or the apparel will not be used by the hunter. Conventional outdoor clothing is often too bulky to allow sufficient freedom of motion for the hunter to quickly and accurately bring his or her firearm to bear on the intended prey. Removal of such clothing, either fully or partially, is often necessary when prey appears in order to accurately aim and shoot the hunter's firearm. Such clothing often is too noisy when moved, scaring the prey off when the hunter raises his or her firearm into shooting position or when the hunter removes bulky clothing. Additionally, tree stands and similar locations usually have little or no extra space or mechanisms for placement or storage of such clothing.

SUMMARY OF THE INVENTION

The present invention solves the problems discussed above by providing a removable weather barrier that can be secured to the base of a tree stand.

One aspect of the invention is an apparatus for keeping a person warm while in a stand having a base connected to a tree, including a generally tubular length of material having an open end and a closed end, wherein the closed end includes a fastener for securing the apparatus to the base of the stand.

Another aspect of the invention is an apparatus for keeping a person warm while in a stand having a base connected to a tree, including a generally tubular length of material having an open end and a closed end, wherein the closed end includes a fastener for securing the apparatus to the base of the stand, an elastic band encircling the open end, and a protective mat secured to the closed end of the apparatus.

Another aspect of the invention is a method of keeping a person warm while in a stand having a base connected to a tree, including the steps of inserting one or both feet and legs into a generally tubular length of material having an open end and a closed end, wherein the closed end is secured to the base of the stand by a fastener, and pulling the open end of the length of material up to a desired height.

A feature of the invention is single interior cavity formed by an insulated, weatherproof, and/or pliant material that retains body heat close to a wearer's feet, legs, and portions of the torso.

Another feature of the invention is the provision of large, insulated, and/or weatherproof pockets for each of the user's hands, spacious enough to accommodate hands wearing hunting gloves.

Another feature of the invention is that it can be removably attached to the base of a tree stand.

Another feature of the invention is a means for efficiently stowing the body warmer on a traditional tree stand, without hindering the user's activities.

An advantage of the invention is that it need not be removed from the user's body during upper body movement, such as shooting.

Another advantage of the invention is that it is removed easily and quickly from the wearer's body when desired.

A further advantage of the invention is that it is light and compact for easy and convenient carrying and storage.

EMBODIMENTS OF THE INVENTION

Figure 1:
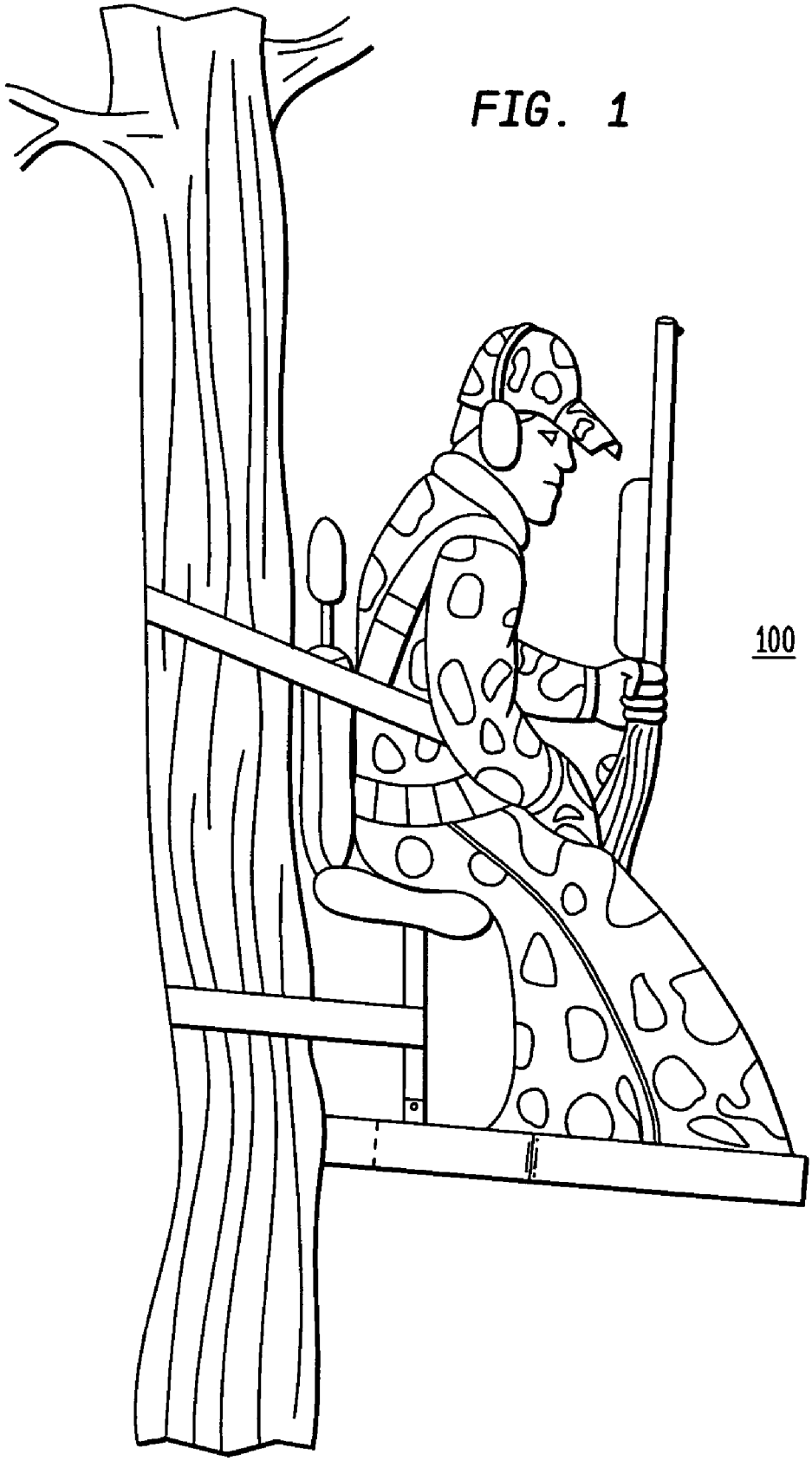
FIG. 1 is a perspective view of an embodiment of the invention as used by a hunter in a tree stand.

FIG. 1 shows a hunter in a tree stand using an apparatus 100 of the present invention for keeping warm.

Figure 2:
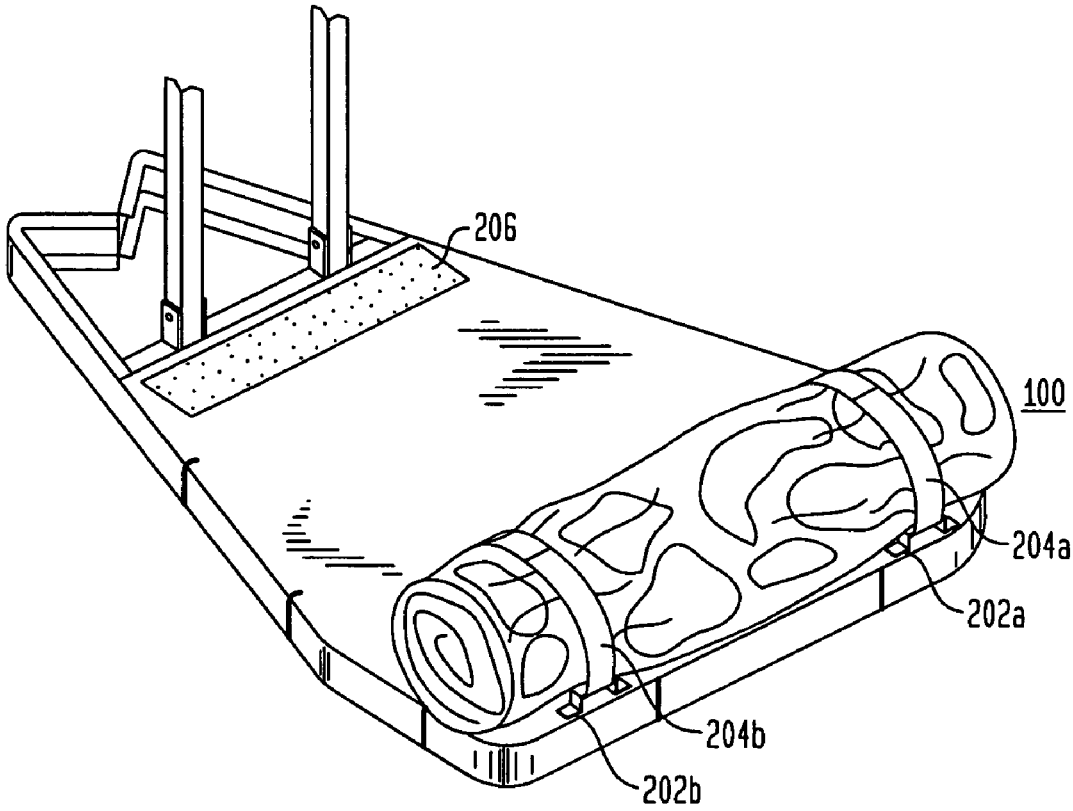
FIG. 2 is a top perspective view of the invention rolled up and stowed securely on the front end of a tree stand.

FIG. 2 shows the apparatus 100 in a rolled-up position. A bracket can be mounted to the base of the tree stand for maintaining the apparatus 100 when in the rolled-up position. In a presently preferred embodiment, two brackets 202*a* and 202*b* are mounted to the base of the tree stand. Providing two brackets is not a requirement of the invention, but is convenient in many preferred embodiments because having two brackets helps to better secure the apparatus 100. As will be apparent to those skilled in the art, the brackets 202*a* and 202*b* can be mounted virtually anywhere on the base of the tree stand, it is presently preferred, however, to mount the brackets 202*a* and 202*b* to the front (the end away from the tree) of the tree stand. In so doing, the apparatus 100 is rolled away from the tree when stowed in a rolled-up position thereby creating a foot rest near the front of the stand.

The apparatus 100 can be secured in the rolled-up position by fastening bands 204*a* and 204*b* to the brackets 202*a* and 202*b*, respectively. Bands 204*a* and 204*b* preferably are self-securing. Non-limiting examples of self-securing bands are nylon cable ties and Velcro® straps having a side with loops and a side with hooks. In a presently preferred embodiment, the bands 204*a* and 204*b* are Velcro® straps.

The apparatus 100 can be secured when in an unrolled position to the base of the tree stand by a fastener (not shown) connected to the closed end of the apparatus 100. An example of a fastener is a strip of hooks or loops. A corresponding strip 206 of hooks or loops can be connected to the back of the tree stand. In a presently preferred embodiment, two strips of hooks or loops are secured to the base of the tree stand. A first strip is secured near the front of the base of the stand and a second strip, e.g., 206, is secured near the back of the base of the stand. Two corresponding strips of hooks or loops are secured to the closed end of the apparatus 100. As a result, the closed end of the apparatus 100 is secured to the base of the tree stand when the apparatus 100 is unrolled and the strips on the closed end of the apparatus 100 contact the strips on the base of the tree stand.

Figure 3:
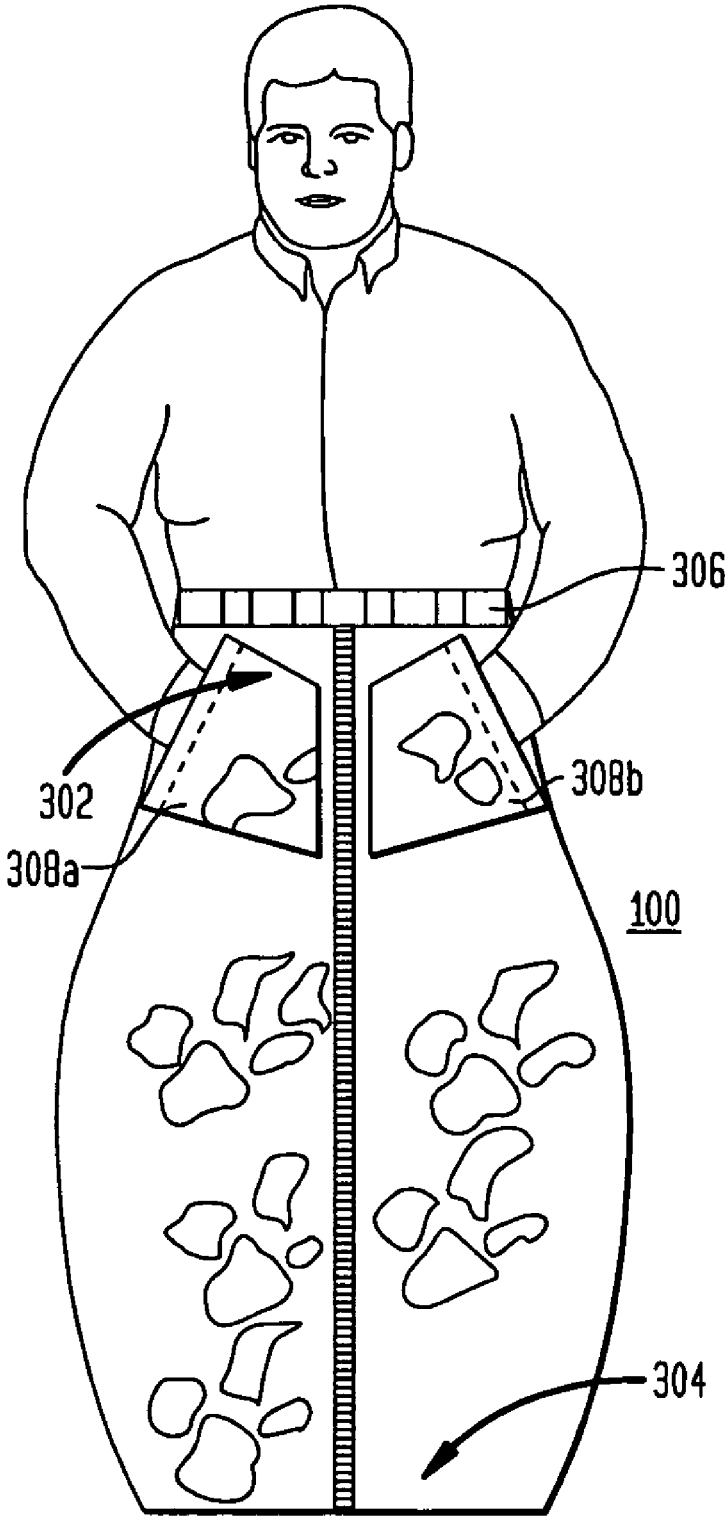
FIG. 3 is a planar front view of the invention as used by a hunter.

FIG. 3 shows the apparatus 100 unrolled and extended around a hunter's waist. The apparatus 100 is a generally tubular length of material having an open end 302 and a closed end 304. The apparatus 100 can include an elastic band 306 extending around the circumference of the open end 302. The apparatus 100 can include pockets 308*a* and 308*b*. The pockets 308*a* and 308*b* preferably are on the outside of the apparatus 100 as shown in FIG. 3, but also can be on the inside of the apparatus 100.

Figure 4:
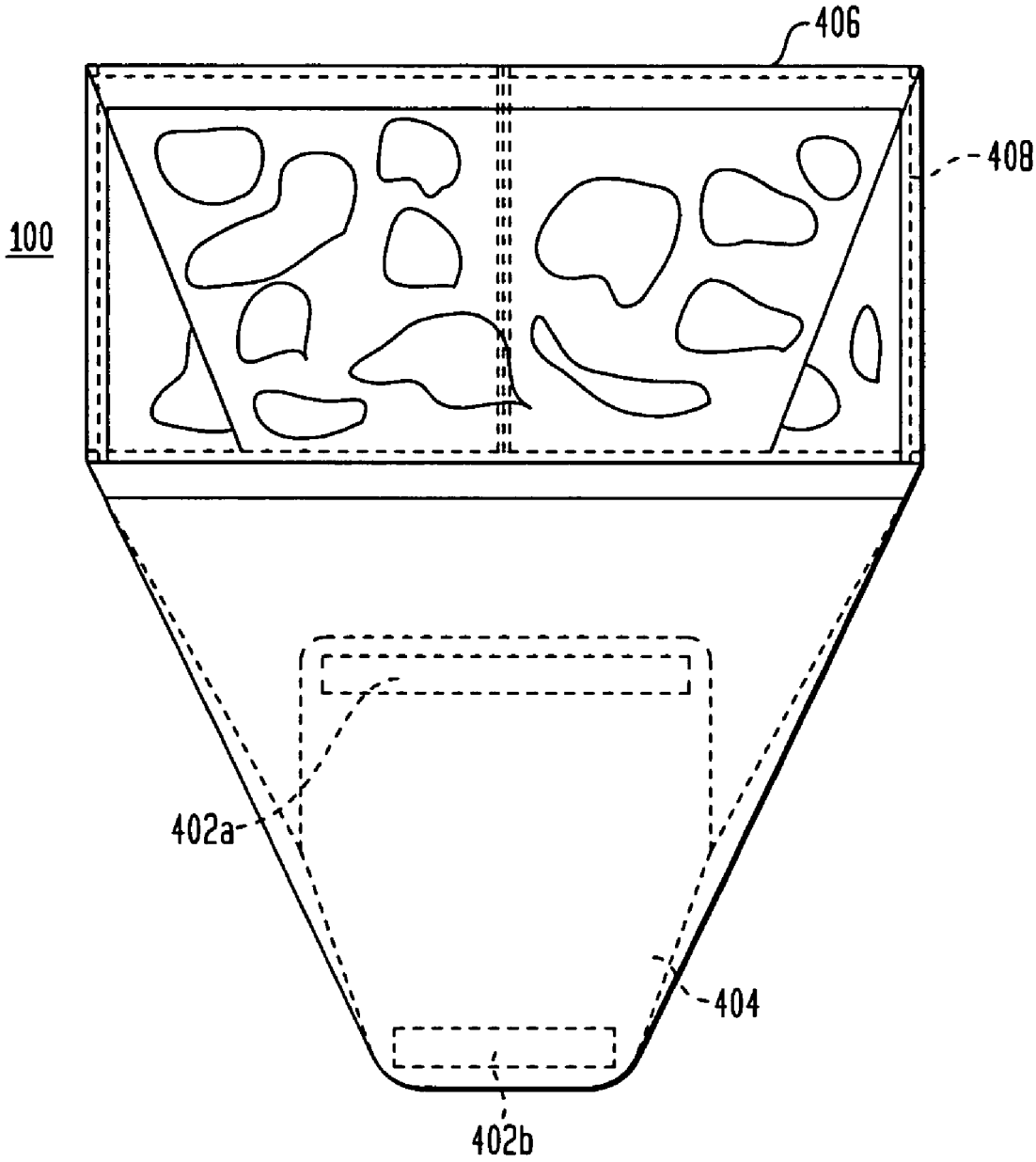
FIG. 4 is a plan view of an embodiment of the invention.

FIG. 4 shows exemplary fasteners 402*a* and 402*b* on the closed end 304 of the apparatus 100. As discussed above, the preferred fasteners 402*a* and 402*b* are strips of loops or hooks on the closed end 304 of the apparatus 100 together with corresponding strips of loops or hooks attached to the base of the tree stand. The closed end of the apparatus 100 also can include a protective mat 404. The protective mat 404 preferably is shaped to conform to the shape of the base of the tree stand with which the apparatus 100 is being used. In a presently preferred embodiment, the protective mat 404 is a section of indoor-outdoor carpet. As will be apparent to those having skill in the art, the mat 404 can be attached to the closed end 304 of the apparatus 100 by many means, such as a zipper, snaps, loop and hook strips, stitches, etc. The most preferred means for attaching the mat 404 to the closed end 304 of the apparatus 100 is by sewing the mat 404 thereto. In those embodiments of the invention having a protective mat 404, fasteners 402*a* and 402*b* can be attached to the protective mat 404. As discussed above, the most preferred fastener 402 is one or more loop and hook strips. In a preferred embodiment, one or more strips 402*a* and 402*b* of hook fastener are attached to the outside of the closed end 304 of the apparatus 100 and one or more corresponding loop fasteners are connected to the base of the tree stand.

The apparatus 100 preferably includes one or more layers of material extending from the closed end 304 to the open end 302, thereby forming a generally tubular, or cylindrical, means for keeping a person warm. Non-limiting examples of acceptable materials out of which the apparatus 100 can be made include nylon, polar fleece, parachute silk, GORE-TEX®, Windstopper®, and combinations thereof. These materials can exist alone, or can be layered to create a desired combination of stealth, comfort, and protection from the elements. In a presently preferred embodiment, the apparatus 100 has an outer layer 406 of parachute silk and/or GORE-TEX® and an inner layer 408 of polar fleece. The outer layer 406 and inner layer 408 preferably are triple stitched together with about seven to about eight stitches per inch. The apparatus 100 can be reversible, meaning that both the "inside" and the "outside" can have a protective mat 404 and fasteners 402*a* and 402*b*.

In operation, the apparatus 100 can be rolled up and secured near the end of the base of a tree stand as shown in FIG. 2. In this position, the apparatus 100 can be used as a foot rest while a hunter is seated in his or her tree stand. The apparatus 100 can be secured in this rolled-up position by bands 204*a* and 204*b*. Bands 204*a* and 204*b* preferably are wrapped around the apparatus 100 and through brackets 202*a* and 202*b*, respectively. Each band 204*a* and 204*b* is then secured to itself. In addition, the apparatus 100 is secured in the rolled-up position by connecting fastener 402*b* to a corresponding strip of hook or loop fastener secured to the front of the base of the tree stand.

In order to use the apparatus 100, a user releases bands 204*a* and 204*b*. The apparatus 100 is then unrolled back toward the tree, i.e., the back of the tree stand. The closed end 304 of the apparatus 100 is secured to the base of the tree stand by connecting fastener 402*a* to a corresponding strip 206 of hook or loop fastener secured to the back of the base of the tree stand. The user then inserts his or her feet and legs through the open end 302 of the apparatus 100 and pulls the elastic band 306 up to the desired level. The elastic band 306 keeps the apparatus 100 snug around the user thereby preventing the loss of heat through the open end 302. To remove the apparatus 100, the user simply reverses the foregoing steps and secures the apparatus 100 to the base of the tree stand in the rolled-up position with the bands 204*a* and 204*b* and the brackets 202*a* and 202*b*.

CONCLUSION

While various embodiments of the present invention have been described above, it should be understood that they have been presented by the way of example only, and not limitation. It will be understood by those skilled in the art that various changes in form and details may be made therein without departing from the spirit and scope of the invention. Thus, the breadth and scope of the invention should not be limited by any of the above-described exemplary embodiments.

What is claimed is:

1. An apparatus for keeping a person warm while in a tree stand, wherein the apparatus includes a tree stand base, the apparatus comprising:

a generally tubular length of material having an open end, a closed end, an inner surface, and an outer surface;

an elastic band encircling said open end;

a protective mat secured to the outer surface of the closed end of the apparatus;

a tree stand base comprising a stand upon which the person may be positioned;

a fastener attached to an outside bottom surface of the protective mat for securing the closed end of the apparatus to the tree stand base; and a complementary fastener attached to the tree stand base, wherein the complementary fastener complements and connects to the fastener.

2. The apparatus of claim 1, further comprising a pocket in said tubular length of material at or near said open end.

3. The apparatus of claim 1, wherein said material is a weatherproof material.

4. A method of keeping a person warm while in a tree stand, comprising the steps of:

(a) obtaining an apparatus of a generally tubular length of material comprising:

an open end, a closed end, an inner surface, and an outer surface;

an elastic band encircling said open end;

a protective mat secured to the outer surface of the closed end of the apparatus;

a tree stand base comprising a stand upon which the person may be positioned;

an outside bottom surface fastener of the protective mat for securing the closed end of the apparatus to the tree stand base; and a complementary fastener attached to the tree stand base, wherein the complementary fastener complements and connects to the fastener;

(b) getting onto the tree stand base;

(c) inserting one or both feet and legs into the generally tubular length of material; and (d) pulling the open end of the length of material up to a desired height.

5. The apparatus of claim 3, wherein the weatherproof material is chosen from nylon, polar fleece, and parachute silk.

6. The apparatus of claim 3, wherein the inner surface is polar fleece and the outer surface is either parachute silk or nylon.

* * * * *